US006145331A

United States Patent [19]

Tuhro

[11] Patent Number: 6,145,331

[45] Date of Patent: Nov. 14, 2000

[54] HEAT RECOVERY MANAGEMENT SYSTEM FOR TRANSFERRING AN IMAGE IN A DEVELOPMENT SYSTEM

[75] Inventor: Richard H. Tuhro, Webster, N.Y.

[73] Assignee: Xerox Corporation, Stamford, Conn.

[21] Appl. No.: 09/206,469

[22] Filed: Dec. 7, 1998

Related U.S. Application Data

[60] Provisional application No. 60/101,577, Sep. 24, 1998.

[51] Int. Cl.[7] ..... F28D 11/00; F25B 27/00

[52] U.S. Cl. ..... 62/186; 62/238.6; 101/487; 165/86

[58] Field of Search ..... 101/487, 488; 62/238.6, 186; 165/86, 104.19; 34/391, 62

[56] References Cited

U.S. PATENT DOCUMENTS 4,188,995 2/1980 Hinkle ..... 165/104.19
4,355,521 10/1982 Tsai ..... 62/238.6
4,783,223 11/1988 Jendrichowski et al. ..... 165/47 X
5,471,927 12/1995 Frank et al. ..... 101/487 X

*Primary Examiner*—William Wayner
*Attorney, Agent, or Firm*—Michael J. Nickerson

[57] ABSTRACT

A heat recovery management system for transferring an image to a print media in a development system of the type having an intermediate belt. The system comprises a first station that receives an energy-transfer medium to heat the belt at a first position utilizing heat from the energy-transfer medium. The first station outputs the energy-transfer medium with a reduced heat content and a second station receives the reduced heat content energy-transfer medium from the first station. The second station absorbs heat from the belt at a second position after which the second station outputs heat enriched energy to the energy-transfer medium and circulates the heat enriched energy-transfer medium back to the first station.

16 Claims, 3 Drawing Sheets

HEAT RECOVERY MANAGEMENT SYSTEM FOR TRANSFERRING AN IMAGE IN A DEVELOPMENT SYSTEM

This patent application claims priority under 35 U.S.C. §119 to provisional patent application No. 60/101,577, filed on Sep. 24, 1998.

FIELD OF THE INVENTION

This invention relates generally to a heat recovery management system suitable for use in an electrostatographic printing machine, especially a liquid developer type printing machine. More specifically, the present invention is directed to a heat recovery management system for transferring an image in a liquid developer printing machine of the type having an intermediate transfer member.

BACKGROUND OF THE PRESENT INVENTION

Generally, the process of electrostatographic production is initiated by exposing light representing an original document onto a substantially uniformly charged photoreceptive member, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developing materials comprising a liquid carrier having toner particles immersed therein have been successfully utilized to develop electrostatic latent images, wherein the liquid developing material is applied to the photoconductive surface with the toner particles being attracted toward the image areas of the latent image to form a developed liquid image on the photoreceptive member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The described electrostatographic production process is well known and is useful for light lens copying from an original document. Analogous processes also exist in other electrostatographic production applications such as, for example, digital laser printing where a latent image is formed on the photoconductive surface by a modulated laser beam, or ionographic printing and reproduction where charge is deposited on a charge retentive surface in response to electronically generated or stored images.

In a liquid development system, an intermediate belt transfers the toner particles of the developed image from the photoreceptive member to the copy substrate. The transfer belt first passes under a heating element to melt the toner particles before they bond to the copy substrate. During the heating process, the toner particles maintain their position on the transfer belt, so as not to alter the image they represent while softening and coalescing. The transfer belt thereafter advances to a fusing station where a pressure roll bonds the melted toner to the copy substrate before it exits the printing machine. After the copy substrate leaves the machine, the belt continues to advance towards the photoconductive member to transfer the next image. Before the transfer belt contacts the photoconductive member, the belt's surface is cooled to prevent damage to the photoconductive member by the residual heat that otherwise remains on the belt.

One conventional method of removing heat from the surface of the transfer belt involves the use of an active cooling system. A typical vapor cycle cooling system exacts heat from the belt using the principles of evaporation and condensation. On passing a liquid from its liquid state to a vaporous state, the liquid absorbs the heat and subsequently gives it off again on condensing. A compressor draws away the vapor, compresses it, passes it to a condenser, where it parts with its heat. Another method of removing heat from the transfer belt involves the use of a non-vapor cycle system. In the non-vapor cycle system large amounts of air circulate through the printing machine to cool the belt before an exhaust expels the air from the machine and the room it occupies. Alternatively, the circulation of water overcomes problems with duct work, noise and dust control which are associated with the movement of air.

While both the vapor and non-vapor systems maintain control over one temperature exchange on the transfer belt surface; however, it is desirable to have a system that maintains control over two temperature exchanges. This is especially important in electrostatographic printing machines inasmuch as a single heat recovery management system can heat the transfer belt and then cool it. Such a system conserves energy and provides substantial operating cost reduction.

The following disclosures may relate to various aspects of the present invention.

U.S. Pat. No. 5,333,677

Patentee: Molivadas

Issued: Aug. 2, 1994

U.S. Pat. No. 5,660,052

Patentee: Kenyon et al.

Issued: Aug. 26, 1997

The disclosures of the above-identified patents may be briefly summarized as follows:

U.S. Pat. No. 5,333,677 discloses various techniques for improving heat transfer systems. The heat transfer systems contain an energy transfer medium that is circulated by a pump. The energy transfer medium absorbs heat by evaporation and releases heat by condensation. The various techniques furnish a self regulation property to the energy transfer medium. Additional properties of heat-release and heat-source control are furnished where applicable.

U.S. Pat. No. 5,660,052 discloses a sensor for detecting the characteristics of a working fluid in a heat exchange system. The sensor is in the form of a thermistor. A control signal is applied to the sensor and a minimum thermal resistance between the thermistor and the working fluid is detected.

SUMMARY OF THE PRESENT INVENTION

In accordance with one aspect of the present invention, there is provided a closed loop heat recovery management system for transferring an image to a print media in a development system of the type having a belt. The system comprises a first station that receives an energy-transfer medium to heat the belt at a first position utilizing heat from the energy-transfer medium. The first station outputs the energy-transfer medium with a reduced heat content and a second station receives the reduced heat content energy-transfer medium from the first station. The second station absorbs heat from the belt at a second position after which the second station outputs heat enriched energy to the energy-transfer medium and circulates the heat enriched energy-transfer medium back to the first station.

In accordance with another aspect of the present invention there is provided, a closed loop heat recovery management system for transferring an image to a print media in a development system of the type having a belt. The system comprises a first member for receiving an energy-transfer medium. The first member heats the belt at a first position utilizing heat from the energy-transfer medium. The first member outputs to the energy-transfer medium so that the energy-transfer medium has a reduced heat content. A second member receives the reduced heat content energy-transfer medium from the first member. The second member absorbs heat from the belt at a second position where the second member outputs heat enriched energy to the energy-transfer medium and circulates the heat enriched energy-transfer medium back to the first member. A condenser located between the first member and the second member for changes the properties of the heat enriched energy-transfer medium flowing out of the second member. Thus, the condenser operates to remove excess heat not required by the first member from the heat enriched energy-transfer medium. A sensor connected between the second member and the first member for senses the properties of the heat enriched energy-transfer medium flowing from the second member to the first member.

In accordance with yet another aspect of the invention, there is provided a closed loop heat management system for transferring an image to a print media in a development system of the type having a transfer belt. The system comprises a first member for receiving an energy-transfer medium. The first member heats the belt at a first position utilizing heat from the energy-transfer medium. The first member outputs to the energy-transfer medium so that the energy-transfer medium has a reduced heat content. A second member receives the reduced heat content energy-transfer medium from the first member and absorbs heat from the belt at a second position. The second member outputs heat enriched energy to the energy-transfer medium and circulates the heat enriched energy-transfer medium back to the first member. A condenser located between the first member and the second member changes the properties of the heat enriched energy-transfer medium flowing out of the second member. A sensor connected between the second member and the first member senses the properties of the heat enriched energy-transfer medium. A fan having at least one operating speed is positioned adjacent to the condenser to direct excess heat away from the condenser. A first valve maintains the energy-transfer medium flowing from the first member to the condenser at a constant pressure. Likewise, a second valve maintains the energy-transfer medium flowing from the condenser to the second member at a constant pressure. A control circuit coupled to the sensor controls the speed of the fan based on the sensed properties of the energy-transfer medium. A compressor changes the properties of the energy-transfer medium flowing between the second medium and the first medium.

BRIEF DESCRIPTION OF THE DRAWINGS

Other features of the present invention will become apparent as the following description proceeds and upon reference to the drawings, in which.

DETAILED DESCRIPTION OF THE PRESENT INVENTION

Figure 1:
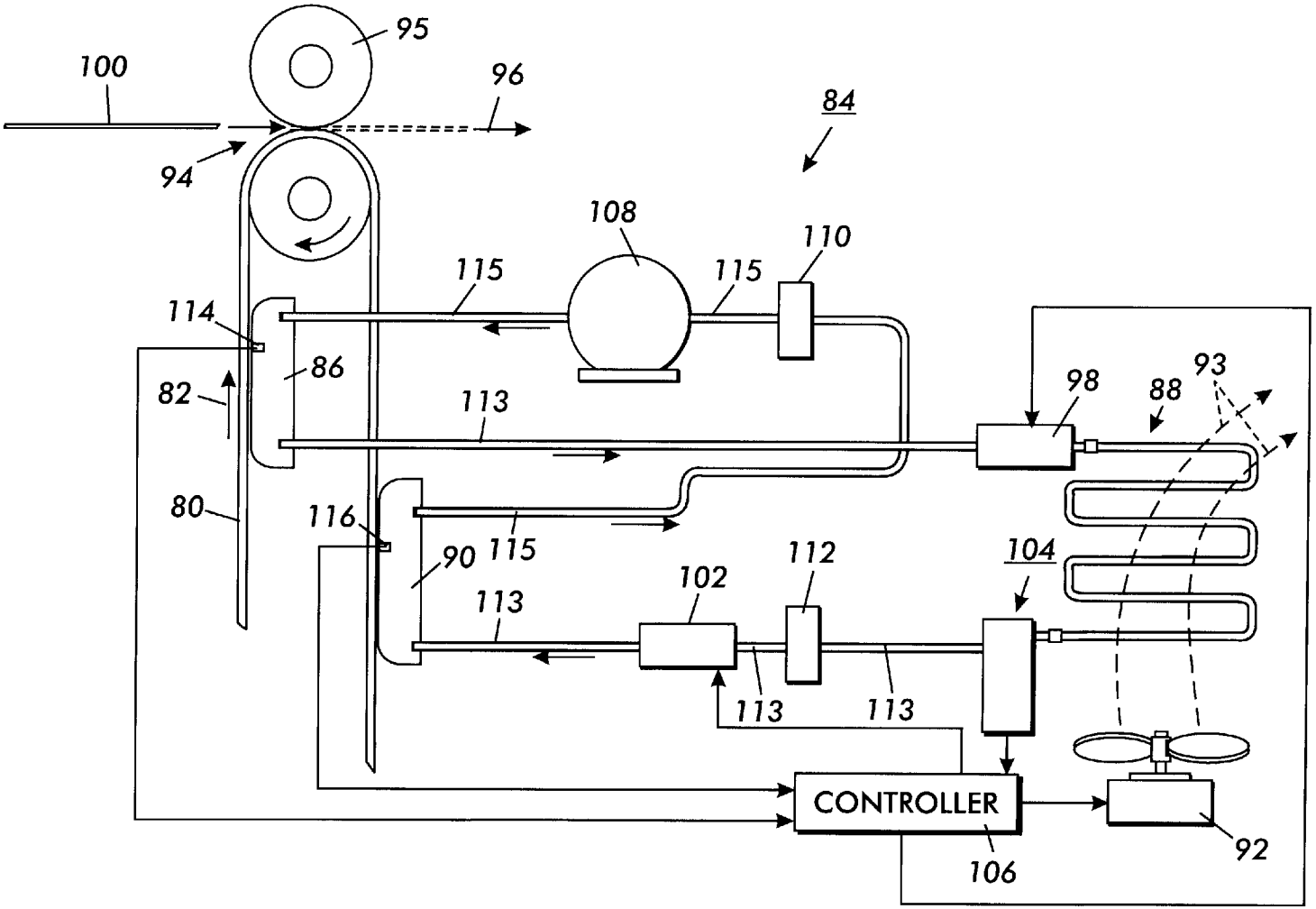
FIG. 1 is a schematic elevational view of an exemplary embodiment of a heat recovery management system in accordance with the present invention.

For a general understanding of the features of the present invention, reference is made to the drawings, wherein like reference numerals have been used throughout to designate identical elements.

Figure 3:
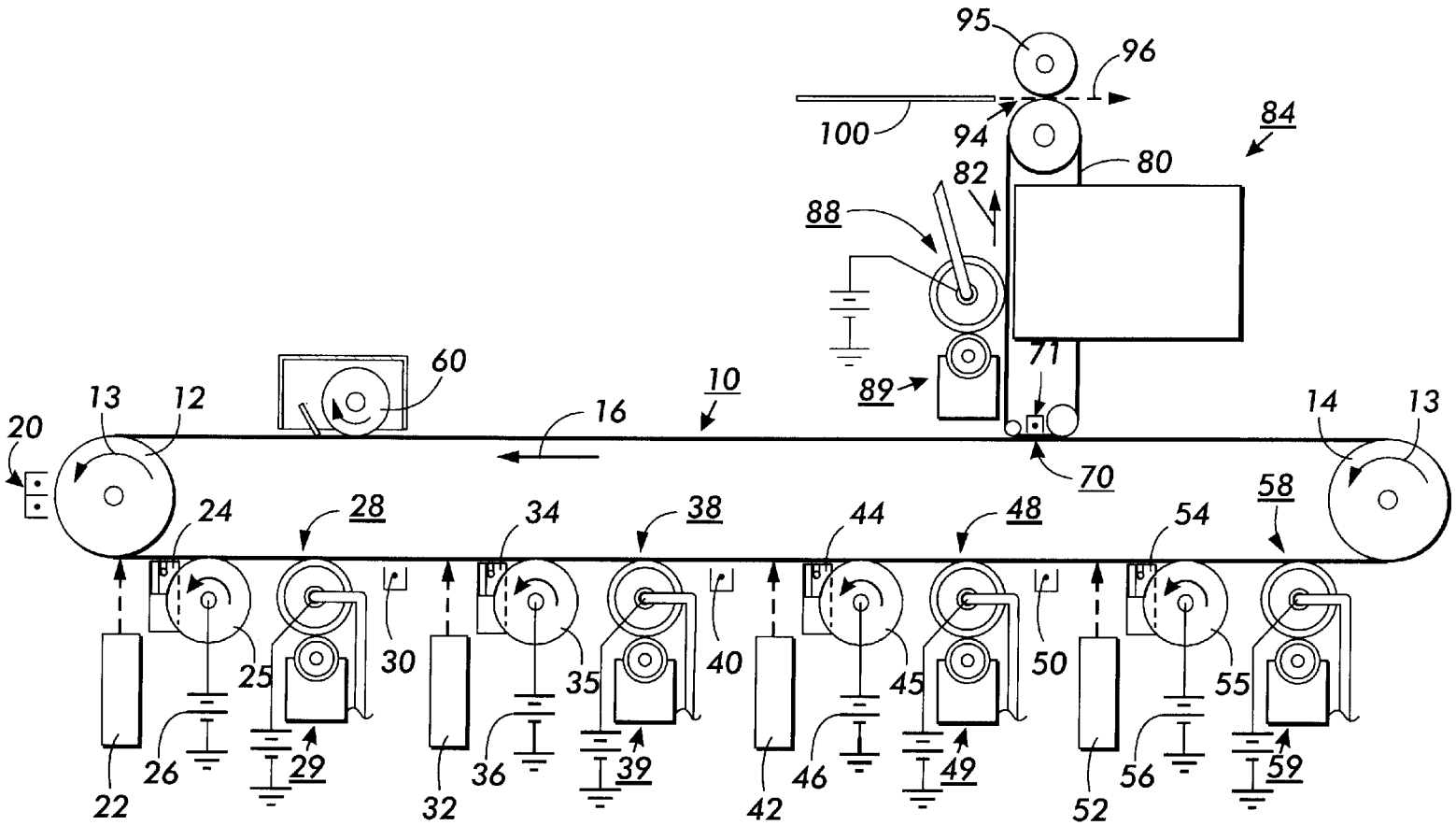
FIG. 3 is a schematic, elevational view of a liquid development type electrostatographic printing machine utilizing the present invention.

FIG. 3 shows a schematic form elevational view of a full-color, liquid developing material based electrostatographic printing machine incorporating the features of the present invention. Inasmuch as the art of electrostatographic printing is well known, the various processing stations employed in the printing machine of FIG. 3 will be described only briefly with reference thereto while the present description will focus on a detailed description of the particular features of the heat management system of the present invention.

It will become apparent from the following discussion that the apparatus of the present invention may also be well-suited for use in a wide variety of systems, devices, apparatus and machines and is not necessarily limited in its application to the field of electrostatographic printing or the particular liquid developing material-based electrostatographic machine described herein. As such, while the present invention will hereinafter be described in connection with preferred a embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, the multicolor electrostatographic printing machine shown employs a photoreceptive belt 10 which is transported in the direction of arrow 16, along a curvilinear path defined by rollers 12 and 14. These rollers are driven in the direction of arrows 13 for advancing successive portions of the photoreceptive belt 10 sequentially through the various processing stations disposed about the path of movement thereof. Initially, the belt 10 passes through a charging station where a corona generating device 20 charges the photoconductive surface of belt 10 to a relatively high, substantially uniform electrical potential.

After the substantially uniform charge is placed on the photoreceptive surface of the belt 10, the printing process proceeds by either placing an input document from a transparent imaging platen (not shown), or by providing a computer generated image signal for discharging the photoconductive surface in accordance with the image information to be generated. The present description is directed toward a Recharge, Expose, and Develop (REaD) color imaging process, wherein the charged photoconductive surface of photoreceptive member 10 is serially exposed by a series of individual raster output scanners (ROSs) 22, 32, 42, and 52 to record a series of latent images thereon. The photoconductive surface is continuously recharged and re-exposed to record latent images thereon corresponding to the subtractive primary of another color of the original. Each latent image is serially developed with appropriately colored toner particles until all the different color toner layers are deposited in superimposed registration with one another on the photoconductive surface. It will be recognized that this REaD process represents only one of various multicolor processing techniques that may be used in conjunction with the present invention, and that the present invention is not intended to be limited to REaD processing or to multicolor processes.

In the exemplary electrostatographic system of FIG. 3, each of the color separated electrostatic latent images are serially developed on the photoreceptive belt 10 by a fountain-type developing apparatus 24, 34, 44 and 54, wherein appropriately colored developing material is transported into contact with the surface of belt 10. Each different color developing material is comprised of charged toner particles disseminated through the liquid carrier, wherein the toner particles are attracted to the latent image areas on the surface of belt 10 by electrophoresis for producing a visible developed image thereon. Commonly, in a liquid developing material-based system, the liquid carrier medium makes up a large amount of the liquid developing composition. Specifically, the liquid medium is usually present in an amount of from about 80 to about 98 percent by weight, although this amount may vary from this range.

The developer station may also include metering rolls 25, 35, 45, and 55 situated adjacent to a corresponding developer fountain 24, 34, 44, and 54, respectively, and in close proximity to the surface of photoreceptive belt 10. The metering roll generally rotates in a direction opposite the movement of the photoconductor surface so as to exert a shear force on the liquid developed image in the area of the nip formed between the surface of the photoreceptor and the metering roll. This shear force removes an initial amount of liquid developing material from the surface of the photoreceptor so as to minimize the thickness of the developing material thereon. The excess developing material removed by the metering roll eventually falls away from the rotating metering roll for collection in a sump (not shown). DC power supplies 26, 36, 46, and 56 may also be provided for maintaining an electrical bias on the metering rolls at a selected polarity for enhancing image development. Each of the developer stations shown in FIG. 3 are substantially identical to one another and represent only one of various known apparatus or systems that can be utilized to apply liquid developing material to the photoconductive surface or other image recording medium.

After image development, it is generally desirable that the liquid developed image be processed or conditioned to compress the image and to remove additional excess liquid carrier therefrom. This "image conditioning" process is directed toward increasing the solids percentage of the image, and can advantageously increase the solids percentage of the image to a range of approximately 25% or higher. An exemplary apparatus for image conditioning is depicted at reference numerals 28, 38, 48 and 58, each comprising a roller member which preferably includes a porous body and a perforated skin covering. In addition, the image conditioning rolls 28, 38, 48 and 58 are typically conductive and biased to a potential having a polarity which repels the charged toner particles of the liquid developed image to compress the image and to inhibit the departure of toner particles therefrom. A vacuum source (not shown) may also be provided, coupled to the interior of the roller, for creating an airflow through the porous roller body to draw liquid carrier from the surface of the photoreceptor 10 for enhancing the process of increasing the percentage of toner solids in the developed image.

In operation, rollers 28, 38, 48 and 58 rotate in contact with the liquid image on belt 10 such that the porous body of roller 28 absorbs excess liquid from the surface of the image through the pores and perforations of the roller skin covering. The vacuum source draws liquid through the roller skin to a central cavity, wherein the collected liquid may be deposited in a receptacle or some other location which permits either disposal or re-circulation of the liquid carrier. The porous roller is thus continuously discharged of excess liquid to provide constant removal of liquid from the developed image on belt 10.

The illustrative multicolor printing process of imaging, development and image conditioning are repeated for subsequent color separations by recharging and re-exposing the belt 10 with charging devices 30, 40 and 50 as well as exposure devices 32, 42 and 52, whereby color image information is superimposed over the previous developed image. For each subsequent exposure an adaptive exposure processing system may be employed for modulating the exposure level of the raster output scanner (ROS) 32, 42 or 52 for a given pixel as a function of the developing material previously developed at the pixel site, thereby allowing toner layers to be made independent of each other. The re-exposed image is next advanced through a corresponding development station and subsequently through an associated image conditioning station, for processing in the manner previously described. Each step is repeated as previously described to create a multi-layer image made up of black, yellow, magenta, and cyan toner particles as provided by each developing station. It should be evident to one skilled in the art that the color of toner at each development station could be provided in a different arrangement.

After the multi-layer image is created on the photoreceptive member 10, it may be advanced to an intermediate transfer station 70 for transferring the image from the photoconductive belt 10 to an intermediate transfer member, identified by reference numeral 80. Thereafter, the intermediate transfer member continues to advance in the direction of arrow 82 to a transfer nip 94 where the developed image is transferred and affixed to a recording substrate 100 transported through nip 94 in the direction of arrow 96. While the image on the photoreceptor 10, after image conditioning thereof, and consequently the image transferred to the intermediate transfer member 80, has a solids percentage in the range of approximately 25%, the optimal solids content for transfer of a liquid image to a copy substrate is above approximately 50%. This solids percentage insures minimal hydrocarbon emissions from an image bearing copy substrate and further advantageously minimizes or eliminates carrier show through on the copy substrate. Thus, it is also desirable to remove excess liquid from the developed image on the intermediate 80, prior to transfer of that image to the copy substrate 100. To that end, prior to transfer of the image from the intermediate transfer member, the liquid developed image thereon may, once again, be conditioned in a manner similar to the image conditioning process described with respect to image conditioning apparatii 28, 38, 48 and 58. Thus, as shown in FIG. 3, an additional image conditioning apparatus 88 is provided adjacent the intermediate transfer member 80 for conditioning the image thereon.

Thereafter, the surface of the intermediate transfer member 80 may be transformed to a molten state by heat, as provided by a loop heat recovery management system 84 which will be discussed in greater detail with reference to FIG. 1. Nevertheless, the heat recovery management system 84 heats the external wall of the intermediate transfer member 80 at a temperature sufficient to cause the toner particles present on the surface to melt, due to mass and thermal conductivity of the intermediate transfer member 80. The toner particles on the surface maintain the position in which they were deposited on the outer surface of member 80, so as not to alter the image pattern which they represent while softening and coalescing due to the application of heat from the exterior wall of member 80. Thereafter, the intermediate transfer member 80 continues to advance in the direction of arrow 82 to a transfix nip 94 where the molten toner particle image is transferred, and bonded, to a copy substrate 100 that travels in a direction indicated by arrow 96. At the transfix nip 94, the toner particles are forced into contact with the surface of the copy substrate 100 by a normal force applied through backup pressure roll 95.

After the developed image is transferred to intermediate transfer member 80, residual liquid developer material may remain on the photoconductive surface of belt 10. A cleaning station 60 is therefore provided, which may include a roller formed of any appropriate synthetic resin that may be driven in a direction opposite to the direction of movement of belt 10, for scrubbing the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from a lamp (not shown) in preparation for a subsequent successive imaging cycle. In this way, successive electrostatic latent images may be developed.

The foregoing describes a liquid development based electrostatographic printing machine incorporating the heat recovery management system of the present invention. Some of the heat delivered to the intermediate belt carries over to the copy substrate. Thereafter, the intermediate belt is cooled before it contacts the photoconductive belt for another image transfer therefrom. For example, if the intermediate transfer belt heats to 100 degrees Centigrade, approximately 55 degrees Centigrade must be removed to prevent damage to the photoconductive belt. The heat recovery management system not only provides heat to the intermediate belt, but it also cools the intermediate belt after the image transfers to the copy substrate. The cooling operation prevents the intermediate belt from raising the temperature of the photoconductive belt above about 45 degrees Centigrade. The deed structure of the heat recovery management system will now be described with reference to FIG. 1.

FIG. 1 depicts an exemplary embodiment of the heat recovery management system in accordance with the present invention. In the heat recovery management system 84 of FIG. 1, two chambers 86 and 90 are interconnected by conduits 113 and 115. An energy-transfer medium (not shown) flows, by way of conduit 113, from chamber 86 to chamber 90 and back to chamber 86 through conduit 115. Chamber 86 is positioned to heat the intermediate transfer belt 80 utilizing heat from the energy-transfer medium before copy substrate 100 arrives at the pressure nip 94.

It is noted that Chamber 86 may also have an auxiliary beating device (not shown) to provide any additional heat to compensate for all the inefficiencies of a heat recovery system The heat content of the energy-transfer medium is reduced, at chamber 86, and the cooled energy-transfer medium flows to chamber 90. Chamber 90 is positioned after the pressure nip 94. There, it cools the intermediate belt 80 by utilizing the cooled energy-transfer medium received from chamber 86. During the cooling process, chamber 90 absorbs heat from the intermediate belt 80 to heat the energy-transfer medium before it flows back to chamber 86 through conduit 115. In this way a substantial portion of the heat supplied to chamber 86 is recovered by the chamber 90. There can, however, never be a complete recovery of the heat, since some heat is expended in circulating the energy-transfer medium from chamber 90 to chamber 86, thus the use of the auxiliary heating device.

In FIG. 1, a high pressure exists in chamber 86, while chamber 90 is under a much lower pressure. If energy is supplied to the energy-transfer medium in chamber 90, the energy-transfer medium evaporates or boils to form a vapor. When the vapor formed by this process circulates from chamber 90 to chamber 86, the vapor condenses into a liquid at the higher pressure in chamber 86. Exemplary energy-transfer media that can be used in the closed loop heat recovery management system 84 include: ammonia, carbon dioxide, and fluorocarbon compounds. Moreover, the work of transporting the energy-transfer medium from a low to high pressure is done by a compressor 108. Compressor 108 draws in the vapor and compresses it to the desired higher pressure. Then, in chamber 86, the vapor condenses at the higher pressure and gives off heat in doing so. In so far as the circulating energy-transfer medium is concerned, chamber 86 functions as a constant temperature condenser. The vapor condensed in chamber 86 expands to a lower pressure and evaporates again in chamber 90. Thus, chamber 90 serves as a constant temperature evaporator. A pair of valves 98 and 102 provide constant boiling point control over the energy-transfer medium circulated between chamber 86 and 90. Valve 98 is located at the exit of chamber 86 and valve 102 is located at the entrance of chamber 90. A pair of thermistors 114 and 116 mount to chambers 86 and 90 respectively. These thermistors 114 and 116 monitor the heating surface of chamber 86 and the cooling surface of the chamber 90 for proper operating temperature before the image transfer process begins. Each thermistor 114 and 116 conveys an electrical signal to a controller 106. The controller 106 thereafter conveys an electrical signal to each valve 98 and 102 to regulate the energy-transfer medium pressure therein. Controller 106 may be a programmable controller or a microprocessor that provides control to the heat management recovery system 84. The valves 98 and 102 may alternatively be constant pressure expansion valves. When valves 98 and 102 are of the constant pressure variety, they do not receive electrical signals from controller 106.

Since the heating requirements of the intermediate transfer belt 80 may not be sufficient to absorb all the heat produced at chamber 86, additional cooling on the high pressure side compressor 108 is required. A condenser 88 provides the additional cooling and insures that the energy-transfer media is composed of more liquid than vapor before entering chamber 90. The heat lost by condenser 88 is a loss to the system and is exhausted by a fan 92. The direction of the exhausted heat is generally indicated by arrows 93. A loss of too much heat results in excessive sub-cooling at the entrance to valve 102 and a liquid quality sensor 104 prevents excessive heat lost by way of condenser 88. The liquid quality sensor 104 measures the liquid quality of the energy-transfer media and sends an electrical signal to controller 106. Controller 106, in turn, controls the speed of fan 92. The operation of sensor 104 will be discussed hereinafter with reference to FIG. 2.

Additional in-line components are included to ensure the proper operation of the heart recovery management system 84. A liquid separator 110, for example, connects between chamber 90 and compressor 108 so that vapor only enters the compressor 108. Similarly, a liquid receiver 112 connects between the liquid quality sensor 104 and valve 102 to insure that liquid only enters valve 102. The liquid receiver 112 further protects the condenser 88 from any excessive charge backing up therein.

Figure 2:
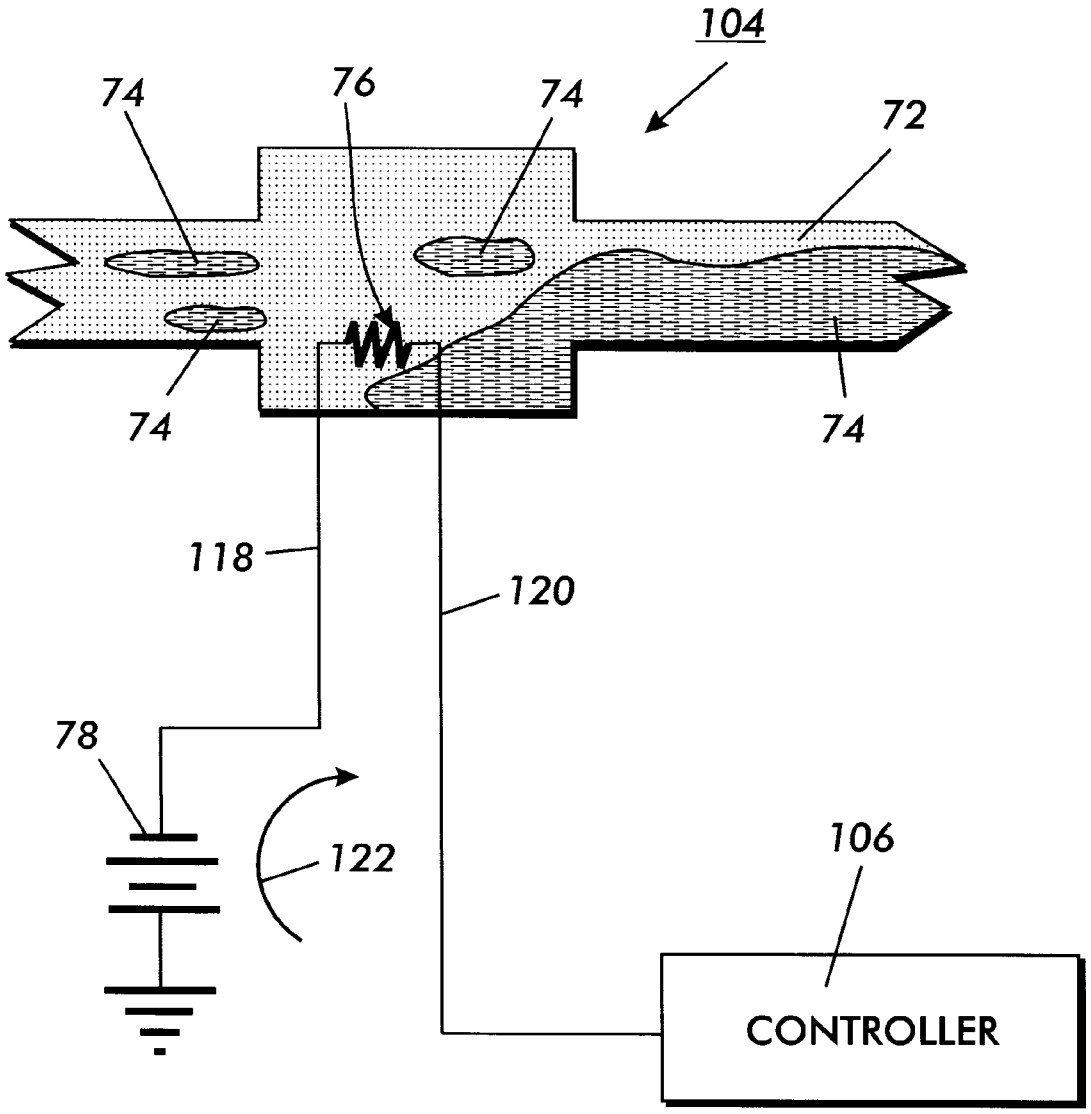
FIG. 2 is a schematic view of a liquid quality sensor used in the present invention.

FIG. 2 schematically illustrates the liquid quality sensor 104 having a positive coefficient thermistor 76 therein. The positive coefficient thermistor 76 is powered by a voltage source 78 through a conductor 118. An output signal from the positive temperature coefficient thermistor is conveyed to controller 106 by a conductor 120. When the positive coefficient thermistor 76 is surrounded by a liquefied portion 72 of the energy transfer medium, a relatively small amount of heat in the sensor 104 is lost to the liquid. The amount of heat in sensor 104 is generated by an electrical current 122 flowing from the voltage source 78 through the electrical resistance of the positive temperature coefficient thermistor 76. When the liquid quality of the energy transfer medium degrades and a vapor 74 surrounds the positive temperature coefficient thermistor 76, the self heating increases the temperature of sensor 104. Consequently, the resistance of the positive temperature coefficient thermistor 76 increases. The increased resistance is sensed by controller 106 by way of the conductor 120 and thereby increases the speed of the fan 92 shown in FIG. 1.

In review, the present invention provides a heat recovery management system. In particular, the system is used for transferring an image from a photoconductive belt to an intermediate transfer belt in a liquid ink based electrostatographic printing machine. A constant temperature condenser heats the intermediate transfer member and a constant temperature evaporator cools it. The temperature is less critical on the cool temperature side of the intermediate transfer belt than on the high temperature side. However, the temperature is controlled at the cool temperature side to limit the stress on the intermediate transfer belt and to keep the photoconductive belt at a tolerable temperature. The temperature is controlled by a pressure valve and a liquid quality sensor. A fan exhausts the wasted heat away from the heat recovery system.

It is, therefore, apparent that there has been provided, in accordance with the present invention, a heat recovery management system for transferring an image in a liquid ink type electrostatographic printing machine. The apparatus described herein fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. A closed loop heat recovery management system for transferring an image to a print media in a liquid ink development system of the type having a belt, comprising:

a first member for receiving an energy-transfer medium;

said first member heating the belt at a first position utilizing heat from said energy-transfer medium;

said first member outputting to said energy-transfer medium; said energy-transfer medium having a reduced heat content;

a second member for receiving said reduced heat content energy-transfer medium from said first member;

said second member absorbing heat from the belt at a second position;

said second member outputting heat enriched energy to said energy-transfer medium and circulating said heat enriched energy-transfer medium back to said first member;

a condenser located between said first member and said second member for changing the properties of said heat enriched energy-transfer medium flowing out of said second member;

said condenser operating to remove excess heat not required by said first member from said heat enriched energy-transfer medium; and a sensor connected between said second member and said first member for sensing the properties of said heat enriched energy-transfer medium flowing from said second member to said first member.

2. The heat recovery management system of claim 1, wherein said energy-transfer medium possesses the property of a liquid.

3. The heat recovery management system of claim 1, wherein said energy-transfer medium possesses the property of a gas.

4. The heat recovery management system of claim 1, wherein said sensor outputs a control signal based on the property of said energy-transfer medium to direct excess heat away from said condenser.

5. The heat recovery management system of claim 1, wherein said first member includes a thermistor to monitor the temperature of said first member.

6. The heat recovery management system of claim 1, wherein said second member includes a thermistor to monitor the temperature of said second member.

7. A closed loop heat management system transferring an image to a print media in a liquid ink development system of the type having a transfer belt, comprising:

a first member for receiving an energy-transfer medium;

said first member heating the belt at a first position utilizing heat from said energy-transfer medium;

said first member outputting to said energy-transfer medium; said energy-transfer medium having a reduced heat content;

a second member for receiving said reduced heat content energy-transfer medium from said first member;

said second member absorbing heat from the belt at a second position;

said second member outputting heat enriched energy to said energy-transfer medium and circulating said heat enriched energy-transfer medium back to said first member;

a condenser located between said first member and said second member for changing the properties of said heat enriched energy-transfer medium flowing out of said second member;

a sensor connected between said second member and said first member for sensing the properties of said heat enriched energy-transfer medium;

a fan positioned adjacent to said condenser to direct excess heat away from said condenser, said fan having at least one operating speed;

a first valve for maintaining said energy-transfer medium flowing from said first member to said condenser at a constant pressure;

a second valve for maintaining said energy-transfer medium flowing from said condenser to said second member at a constant pressure;

a control circuit coupled to said sensor for controlling the speed of said fan based on the sensed properties of said energy-transfer medium; and a compressor to change the properties of said energy-transfer medium flowing between said second member and said first member.

8. The heat recovery management system of claim 7, further comprising:

a liquid separator connected between said compressor and said first member to prevent any liquid from flowing into said first member; and a liquid receiver connected between said sensor and said second valve to insure that a cooled heat-transfer medium flows in said condenser.

9. The heat recovery management system of claim 7, wherein said sensor comprises:

a direct current voltage source; and a thermistor.

10. The heat recovery management system of claim 7, wherein said thermistor is a positive coefficient thermistor.

11. The heat recovery management system of claim 7, wherein said first valve is a constant pressure expansion valve.

12. The heat recovery management system of claim 7, wherein said first valve is a thermistor controlled valve.

13. The heat recovery management system of claim 7, wherein said second valve is a constant pressure expansion valve.

14. The heat recovery management system of claim 7, wherein said second valve is a thermistor controlled valve.

15. The heat recovery management system of claim 7, wherein said first member includes a thermistor to monitor the temperature of said first member.

16. The heat recovery management system of claim 7, wherein said second member includes a thermistor to monitor the temperature of said second member.

* * * * *